US007994992B1

(12) United States Patent
Tam et al.

(10) Patent No.: US 7,994,992 B1
(45) Date of Patent: Aug. 9, 2011

(54) MULTIBAND CURRENT PROBE FED ANTENNA

(75) Inventors: Daniel Tam, San Diego, CA (US); James H. Schukantz, Jr., San Diego, CA (US); Robert S. Abramo, Colorado Springs, CO (US); Peder Hansen, San Diego, CA (US); James C. Logan, San Diego, CA (US); David E. Hurdsman, Spring Valley, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 817 days.

(21) Appl. No.: 11/867,046

(22) Filed: Oct. 4, 2007

(51) Int. Cl.
*H01Q 1/34* (2006.01)

(52) U.S. Cl. ..... 343/709; 343/715; 343/725

(58) Field of Classification Search ..... 343/709, 343/715, 725, 789, 844, 893, 900
See application file for complete search history.

(56) References Cited

U.S. PATENT DOCUMENTS

| | | | | |
|---|---|---|---|---|
| 3,431,487 | A * | 3/1969 | Savage | 323/358 |
| 5,633,648 | A | 5/1997 | Fischer | |
| 6,492,956 | B1 | 12/2002 | Fischer et al. | |
| 2007/0210969 | A1 * | 9/2007 | Vance | 343/702 |

OTHER PUBLICATIONS

John H. Meloling, James H. Schukantz Jr., & Joseph Fischer; A Transmit Mast-Clamp Current Probe for Shipboard HF Communications; IEEE 0-7803-8883-6/05, pp. 17-20, 2005.
Michael Stewart; The Ship as Antenna; Military Information Technology Online Archives, vol. 8, Issue 10, Dec. 22, 2004.
Greg Ordy, Simple RF Current Probes, Feb. 28, 2003, can be accessed online at http://www.seed-solutions.com/gregordy/Amateur%20Radio/Experimentation/RFProbe.htm.

* cited by examiner

*Primary Examiner* — Douglas W Owens
*Assistant Examiner* — Jae Kim
(74) *Attorney, Agent, or Firm* — Kyle Eppele; J. Eric Anderson

(57) ABSTRACT

A multi-band antenna comprising a conductive structure and a plurality of current probes coupled around the conductive structure. Each current probe is designed to receive and transmit in a substantially different frequency band than the other current probes. The current probes are positioned on the conductive structure so as to effectively create a plurality of transmit/receive antennas such that each respective antenna has a voltage standing wave ratio (VSWR) of less than or equal to approximately 3:1 for a given range within each respective frequency band.

21 Claims, 11 Drawing Sheets

Plot of the VSWR for a UHF current probe positioned 17.145 cm (6.75 in) from the base of a 50.8 cm (20 in) tall, 2.54 cm (1 in) diameter brass pole.

Plot of the VSWR for a UHF current probe positioned 5.08 cm (2 in) from the base of a 50.8 cm (20 in) tall, 2.54 cm (1 in) diameter brass pole.

Plot of the VSWR for a VHF current probe positioned 1.27 cm (0.5 in) from the base of a 50.8 cm (20 in) tall, 2.54 cm (1 in) diameter brass pole.

Plot of the VSWR for a UHF current probe positioned 36.83 cm (14.5 in) from the base of a 50.8 cm (20 in) tall, 2.54 cm (1 in) diameter brass pole.

Plot of the VSWR for a HF current probe at the base of a 609.6 cm (240 in) tall aluminum pole.

Plot of the VSWR for a UHF current probe positioned 12.7 cm (5 in) from the base of a 50.8 cm (20 in) tall, 2.54 cm (1 in) diameter brass pole.

MULTIBAND CURRENT PROBE FED ANTENNA

FEDERALLY-SPONSORED RESEARCH AND DEVELOPMENT

This invention (Navy Case No. 84943) is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case Number 84943.

BACKGROUND OF THE INVENTION

With increasing numbers of wireless communications systems available today more and more antennas are required to support them. In many situations the available real estate limits the number of additional antennas that may be added to a site. For example, the area available on building rooftops, and exterior surfaces of automobiles, aircraft, and sea craft, which often serve as antenna placement locations, is particularly limited. There exists a need for a multiple-band antenna with a relatively small footprint.

BRIEF DESCRIPTION OF THE DRAWINGS

Throughout the several views, like elements are referenced using like references.

DETAILED DESCRIPTION OF EMBODIMENTS

Glossary of Terms/Abbreviations

Figure 1:
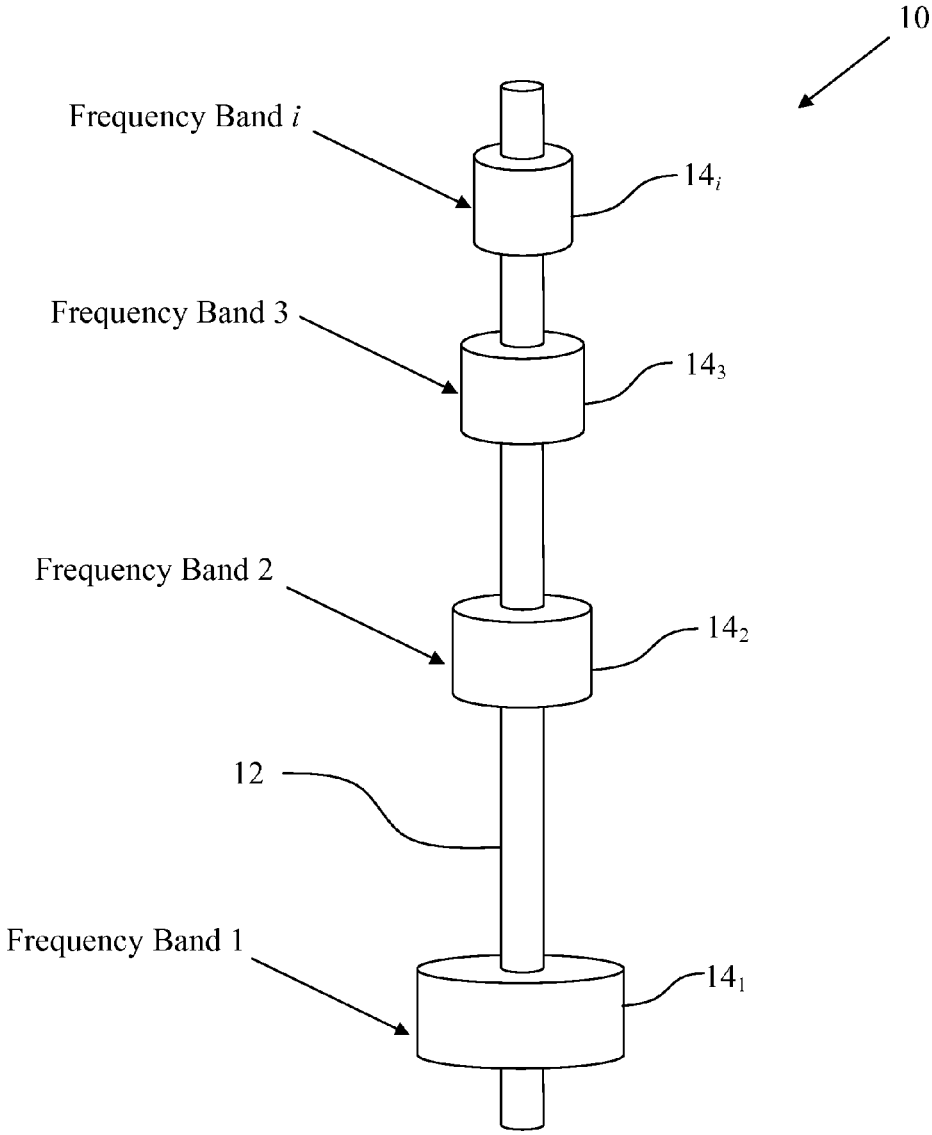
FIG. 1 is a perspective view of the multi-band current probe antenna.

BALUN: balanced to unbalanced transformer
BNC Connector: bayonet Neill-Concelman coaxial cable connector
EMI: electromagnetic interference
GHz: Gigahertz
HF: High Frequency (HF) range (2-100 MHz)
L-Band: (1000-2000 MHz)
MBCP: multi-band current probe
MHz: Megahertz
SMA Connector: SubMiniature version A coaxial cable connector
TNC Connector: threaded Neill-Concelman coaxial cable connector
UHF: Ultra High Frequency (400-1000 MHz)
UNUN: unbalanced to unbalanced transformer
VHF: Very High Frequency (100-400 MHz)
VSWR: voltage standing wave ratio FIG. 1 shows an embodiment of a multi-band current probe (MBCP) antenna 10 that comprises a conductive structure 12, and a plurality of current probes $\mathbf{14}_1$-$\mathbf{14}_i$ coupled around the conductive structure 12, where i is an index. Each current probe 14 is designed to receive and transmit in a substantially different frequency band than the other current probes 14. The current probes 14 are positioned on the conductive structure 12 so as to effectively create a plurality of transmit/receive antennas such that each respective antenna has a voltage standing wave ratio (VSWR) of less than or equal to approximately 3:1 for a given range within each respective frequency band. It is to be understood that even though 4 current probes 14 are shown in FIG. 1, the MBCP antenna 10 is not limited to 4 current probes but may have any number of current probes greater than 2. The conductive structure 12 may be any structure that conducts and is capable of supporting the current probes 14. The conductive structure 12 may be hollow, or solid. Examples of conductive structures include, but are not limited to, ships, ship masts, flag poles, light poles, towers, bridges, building frames, windmills, and plumbing fixtures.

Each current probe 14 comprises a ferrite core 16 and a nonmagnetic, metallic housing 18. Because the core 16 is made out of ferrite material, each current probe 14 acts as a choke to out-of-band currents on the conductive structure. Therefore, no chokes are required for the MBCP transmit and receive antenna 10. In-band, each current probe 14 couples to the conductive structure 12 to act as an antenna. Each ferrite core 16 has the shape of a toroid or its topological equivalent. Each current probe 14 may be designed for a different operating band. For example, one embodiment of the MBCP antenna 10 may comprise a first current probe 14 designed to transmit and receive in the High Frequency (HF) range (2-100 MHz), a second current probe 14 designed to operate in the Very High Frequency (VHF) range (100-400 MHz), a third current probe 14 designed to operate in the Ultra High Frequency (UHF) range (400-1000 MHz), and a fourth current probe 14 designed to operate in the L-band range (1000-2000 MHz). Each current probe 14 may be positioned on the conductive structure 12 such that each current probe 14's VSWR is less than or equal to approximately 3:1 within its operating range. By carefully placing the current probes 14 on the conductive structure 12, one can effectively create a plurality of transmit/receive ¼-wavelength monopole antennas. The housing 18 may be any size or shape that is capable of containing the ferrite core 16.

Figure 2A:
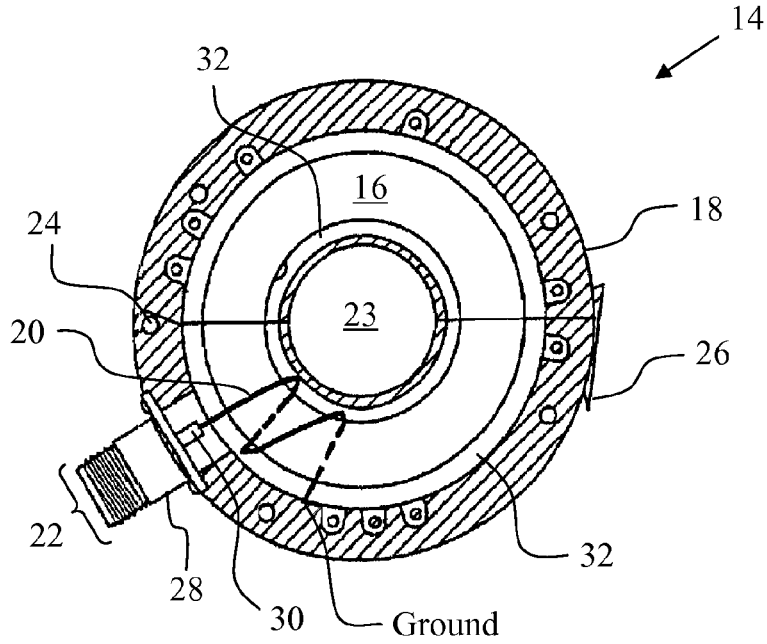
FIG. 2A shows a horizontal cross-sectional view of a current probe.
Figure 2B:
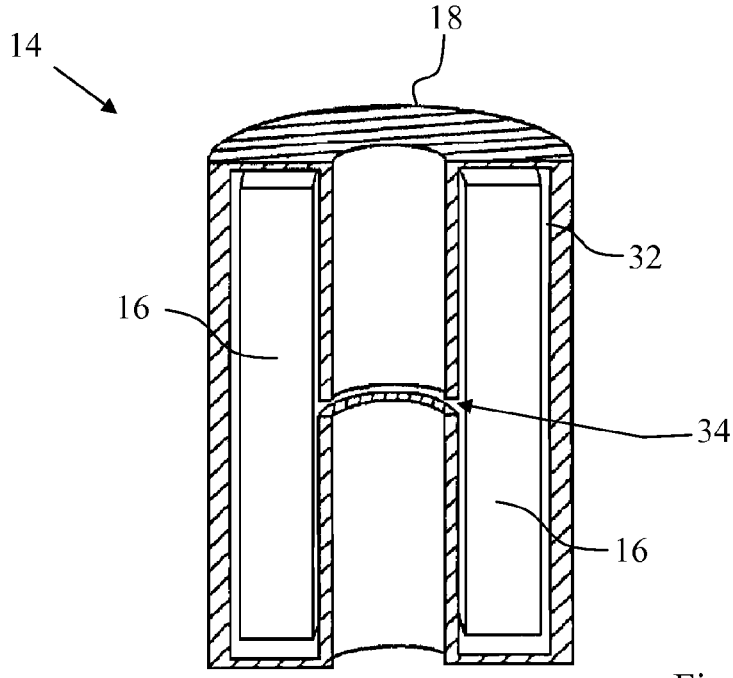
FIG. 2B shows a vertical cross-sectional view of a current probe.

FIGS. 2A and 2B show multiple views of one embodiment of the current probe 14. FIG. 2A shows a horizontal cross-section exposing the relationship of the ferrite core 16 and its primary winding 20 to the housing 18 and a feed connector 22. FIG. 2B shows a vertical cross-section of one half of the current probe 14. The ferrite core 16 is split lengthwise into two halves. FIG. 2A also shows the features that allow the shown embodiment of the current probe 14 to be clamped around a conductive structure 12. A hinge 24 allows this embodiment of the current probe 14 to be hinged open and positioned around the conductive structure 12, such that a section of the conductive structure 12 may be positioned within an aperture 23 of the core 16. In this embodiment, a releasable latch 26 allows the two core halves to be latched together.

In FIG. 2A, the ferrite core 16 and primary winding 20 are contained within the housing 18. The ferrite core 16 may be comprised of any suitable magnetic material with a high resistivity. The primary winding 20 may be wound around the ferrite core 16 for a plurality of turns. The number of turns of the primary winding 20 and the ferrite core 16 materials will provide different inductive and resistive characteristics, affecting the frequency response and thus the insertion loss of the device. The primary winding 20 may consist of a single turn around the ferrite core 16 or several turns around the ferrite core 16. The primary winding 20 may cover only one half of the ferrite core 16, or may extend around both core halves. The primary winding 20 may be terminated with a connection to the housing 18 as a ground, or it can be terminated in a balanced to unbalanced transformer (typically referred to as a BALUN) as described below. An RF signal is coupled into the current probe 14 through the feed connector 22. Examples of the feed connectors 22 include, but are not limited to: BNC (bayonet Neill-Concelman), SMA (SubMiniature version A), TNC (threaded Neill-Concelman), and N-style coaxial connectors. If a coaxial connector is used, the shield 28 portion of the connector 22 is coupled to the housing 18, while the inside conductor 30 of the connector 22 is coupled to the primary winding 20. The primary winding 20 is terminated with a connection to the housing 18. The primary winding 20 and ferrite core 16 may be insulated from the housing 18 by an electrical insulating layer 32. The insulating layer 32 may comprise any suitable electrical insulating materials. The core halves of the ferrite core 16 are generally in contact with each other when the current probe 14 is closed, but, in some instances, an intentional air gap may separate the core halves. However, even when the core halves are in contact with each other, a minute air gap may still exist even though the core faces may be polished to a very smooth finish and pressed tightly against one another. This air gap will result in air gap losses. The so-called air gap loss does not occur in the air gap itself, but is caused by the magnetic flux fringing around the gap and reentering the core in a direction of high loss. As the air gap increases, the fringing flux continues to increase, and some of the fringing flux strikes the core perpendicular to the core, and sets up eddy currents. Core materials with high resistivity may reduce these currents.

FIG. 2B shows a space gap 34 within the interior portion of the housing 18. This space gap 34 may be used to prevent forming a shorted tertiary turn around the primary winding 20. If no space gap 34 were present, the shorted turn of the shield 28 would prevent the current probe 14 from coupling RF current to the conductive structure 12. The embodiment of the current probe 14 shown in FIGS. 2A and 2B may be clamped around a conductive structure 12. Current flow in the primary winding 20 induces a magnetic field with closed flux lines substantially parallel to the ferrite core 16. This magnetic field then induces current flow in the conductive structure 12 clamped within the current probe 14, which results in RF energy transmission. A transmission line transformer may be used to couple the RF energy from a transmitter to the current probe 14. If the primary winding 20 is terminated to the housing 18, an unbalanced to unbalanced (UNUN) transmission line transformer may be used to couple RF energy to the input end of the primary winding 20 of the current probe 14. A balanced to unbalanced transformer (BALUN) may alternatively be used to couple RF energy to the current probe 14. In this configuration, the primary winding 20 may not be terminated at the housing 18. Instead, both the input end and the termination of the primary winding 20 may be connected to the balanced terminals of a BALUN. The unbalanced ends of the BALUN may be connected to a coaxial cable carrying the RF energy from a transmitter. A BALUN may also be used if the RF current injector has no external shield connected to ground. Both BALUNs and UNUNs are well known in the art and are commercially available. However, specially made UNUNs may be required to properly match a transmitter output to the input of the current probe 14. Although FIGS. 2A and 2B show the current probe 14 as configured to clamp around the conductive structure 12, it is to be understood that the manner of mounting the current probe 14 to the conductive structure 12 is not limited to clamping, but any effective manner of positioning the current probe 14 around the conductive structure 12 may be used.

Figure 3:
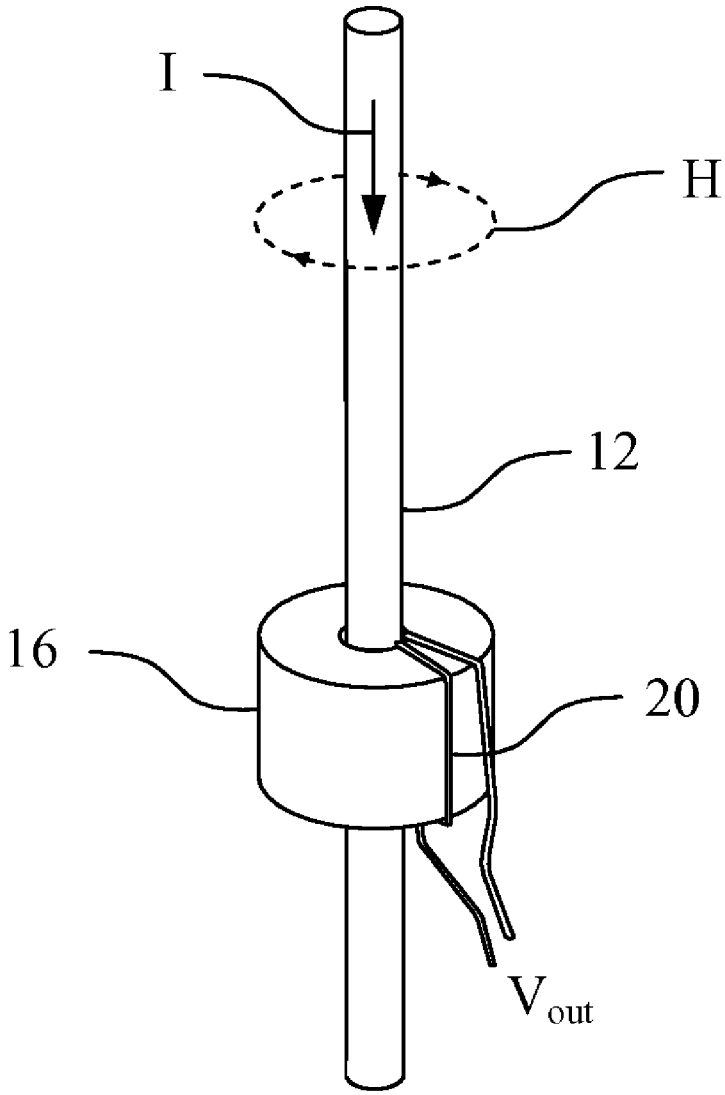
FIG. 3 illustrates an operational concept of an embodiment of a current probe.

FIG. 3 illustrates an operational concept of the current probes 14. An external electric field induces current (I) on the conductive structure 12. The current (I) may be coupled from the conductive structure 12 via the current probe 14 transfer impedance to the input of a receiver or multi-coupler. The current probe 14 may be designed such that the current probe 14 will produce a desired transfer impedance $Z_t$ over the frequency range of interest and provide the required isolation from a co-located transmit system to protect the receive system from damage or electromagnetic interference (EMI) problems. In this instance, the transfer impedance $Z_t=V_{out}/I_{in}$. For transmitting, the primary winding 20 may generate high magnetic fields (H) in the ferrite core 16. This magnetic field (H), which equals $I/2\pi r$, where "r" is the radial distance from the center of the conductive structure 12 to the field point, induces current (I) on the conductive structure 12, which then radiates the energy.

Figure 4:
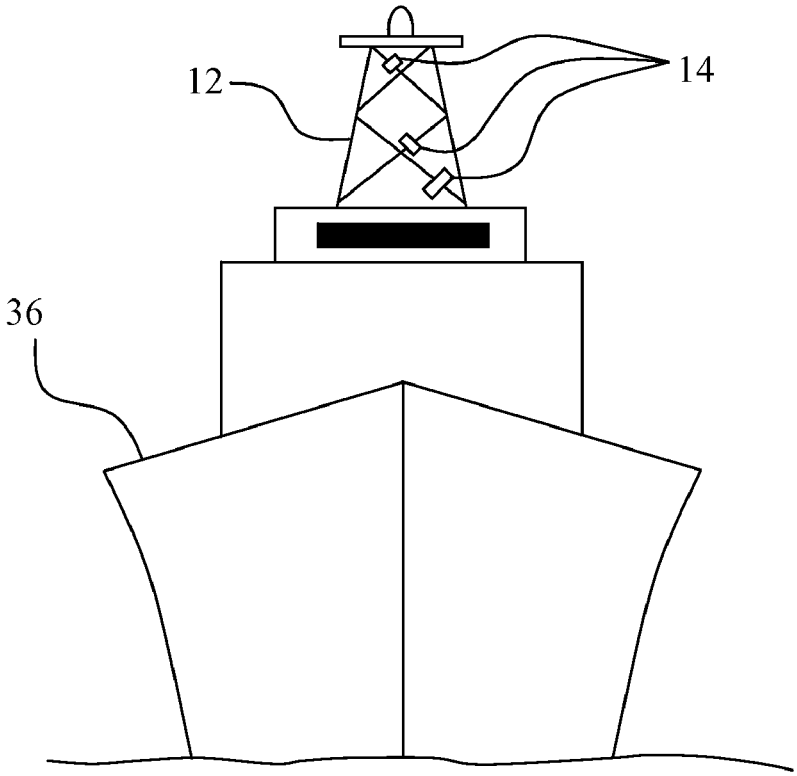
FIG. 4 is an illustration of another embodiment of the multi-band current probe antenna where the conductive structure is a structure on a ship.

FIG. 4 is an illustration of another embodiment of the multi-band current probe antenna 10 where the conductive structure 12 is a structure on a ship 36. As can be seen in FIG. 4, the conductive structure 12 need not be linear, but can be any shape, or size such as the railing or superstructure. The position of each current probe 14 may be determined through an empirical process of adjusting the position of each current probe 14 iteratively until each current probe has a VSWR of approximately 3:1 or less in its corresponding frequency range.

Figure 5:
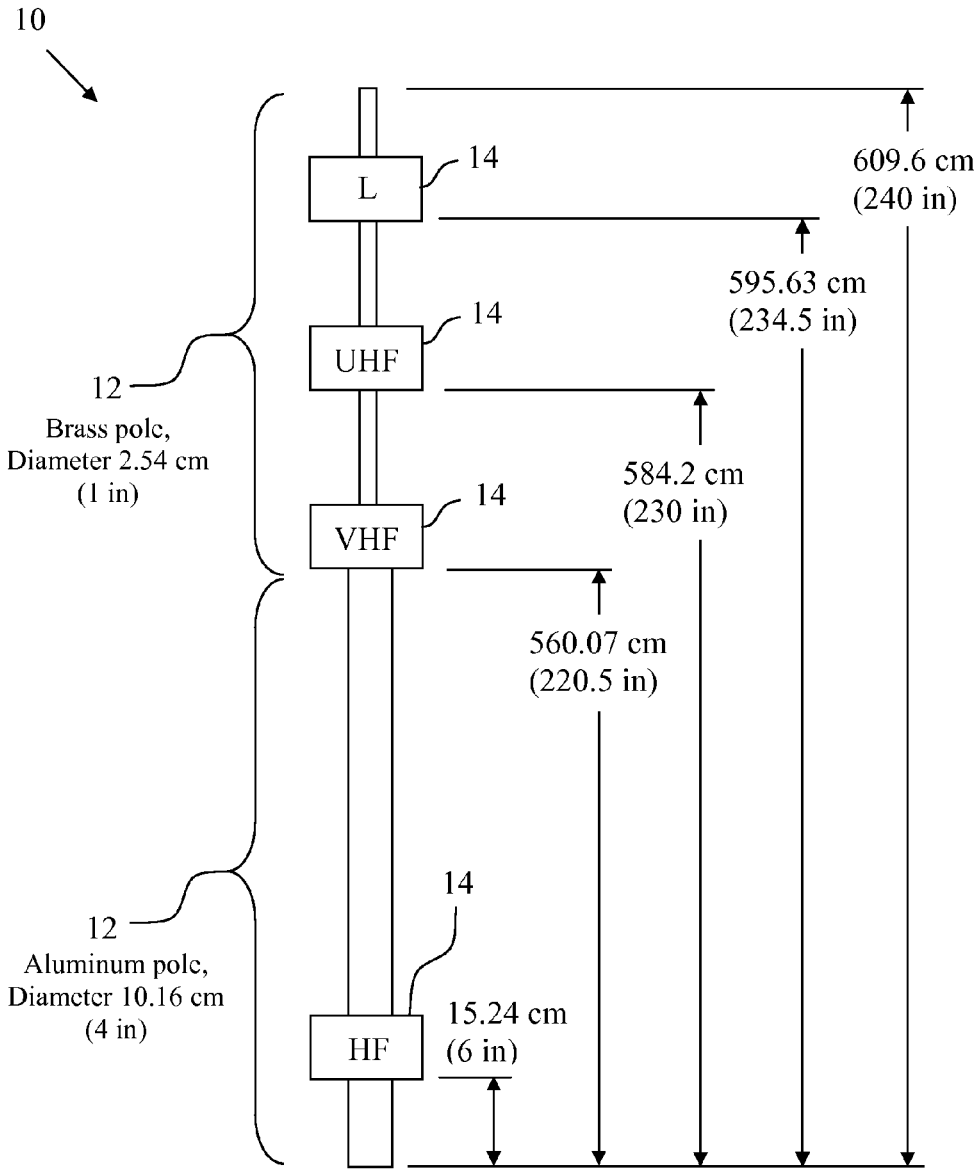
FIG. 5 shows example placement of current probes on a conductive structure.

FIG. 5 shows example placement of the current probes 14 on a conductive structure 12. In the embodiment shown in FIG. 5, the conductive structure 12 is approximately 609.6 cm (240 in) long. Initial placement of each current probe 14 may be determined by calculating the length of a ¼-wavelength monopole antenna from the following equation:

$$\text{¼-wavelength}=\lambda/4=c/4f$$

$\lambda$=wavelength (m)

c=speed of light ($300\times10^6$ m/s)

f=frequency (Hz)

For the embodiment shown in FIG. 5, the current probes 14 may be initially arranged on the conductive structure 12 so as to have effectively one ¼-wavelength monopole antenna stacked on top of another with the lowest-frequency current probe 14 positioned near the base of the conductive structure 12. Then, each current probe 14 may be "tuned" by moving the current probe 14 up and down the conductive structure 12 until about the lowest VSWR is achieved. This process then repeats for the next-higher-frequency current probes 14. After each current probe 14 has been initially placed, the VSWR corresponding to each current probe 14 may be measured again. To compensate for minor impedance coupling interaction, the positions of all the current probes 14 may be adjusted again, following the above procedure, until satisfactory performance is achieved for each current probe 14. As shown in the example embodiment in FIG. 5, the conductive structure 12 may be a pole with segments of different conductive material. In the embodiment shown in FIG. 5, approximately 559 cm (220 in) of the bottom of the conductive structure 12 may be an aluminum pole with a diameter of approximately 10.16 cm (4 in). Also shown in FIG. 5, approximately 559 cm (20 in) of the top of the conductive structure 12 may be a brass pole with a diameter of approximately 2.54 cm (a in). The conductive structure 12 may be approximately 609.6 cm (240 in) in length. A current probe 14, designed to operate in the HF range, may be placed approximately 15.24 cm (6 in) from the base of the pole. A current probe 14, designed to operate in the VHF range, may be placed approximately 560.07 cm (220.5 in) from the base of the pole. Another current probe 14, designed to operate in the UHF range, may be positioned approximately 584.2 cm (230 in) from the base of the pole. Finally, in this embodiment, the final current probe 14, designed to operate in the L-band, may be positioned approximately 595.63 cm (234.5 in) from the base of the conductive structure 12.

Figure 6A:
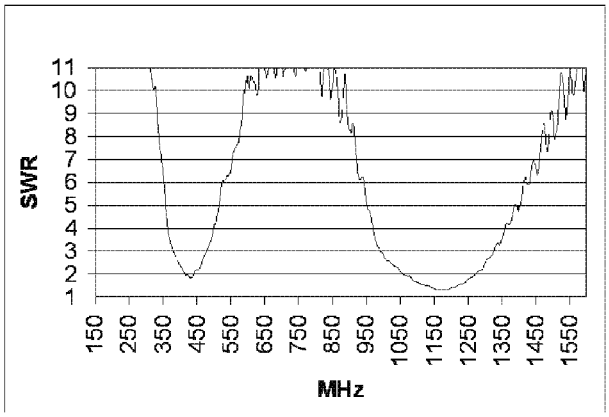
FIG. 6A shows a plot of the VSWR for a UHF current probe positioned 17.145 cm (6.75 in) from the base of a 50.8 cm (20 in) tall brass pole.
Figure 6B:
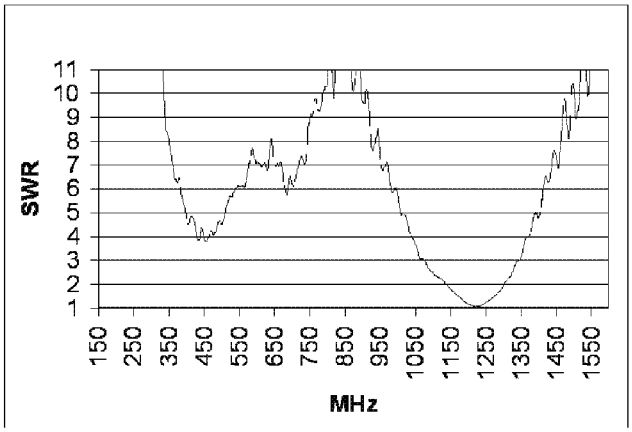
FIG. 6B shows a plot of the VSWR for a UHF current probe positioned 5.08 cm (2 in) from the base of a 50.8 cm (20 in) tall brass pole.
Figure 7A:
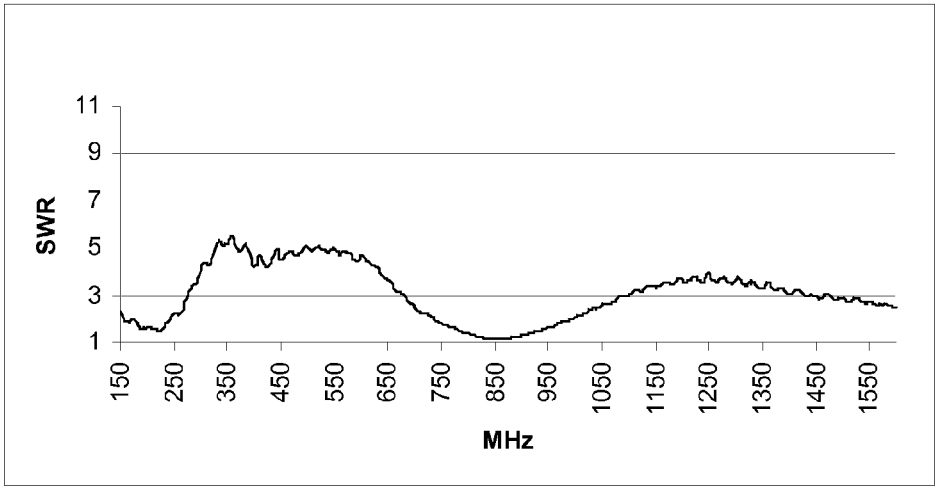
FIG. 7A shows a plot of the VSWR for a VHF current probe positioned 1.27 cm (0.5 in) from the base of a 50.8 cm (20 in) tall brass pole.
Figure 7B:
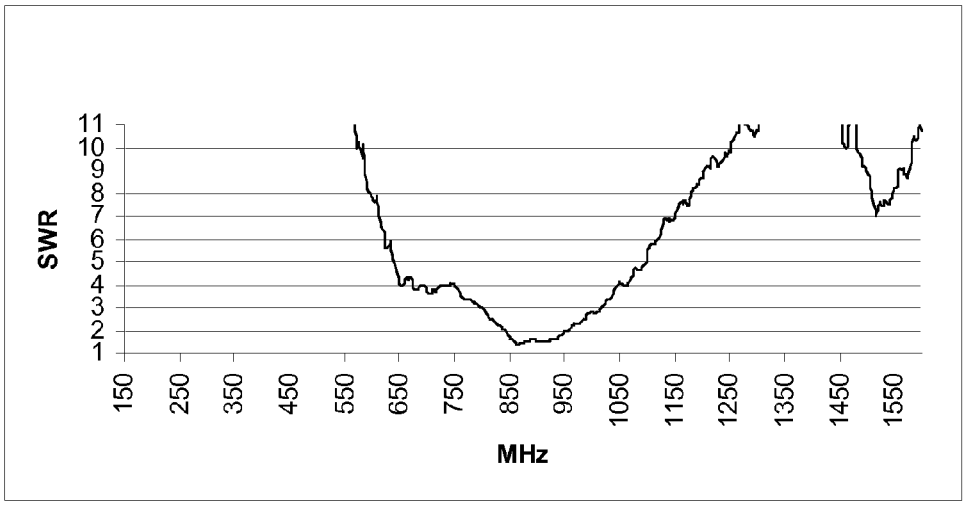
FIG. 7B shows a plot of the VSWR for a UHF current probe positioned 36.83 cm (14.5 in) from the base of a 50.8 cm (20 in) tall brass pole.
Figure 8A:
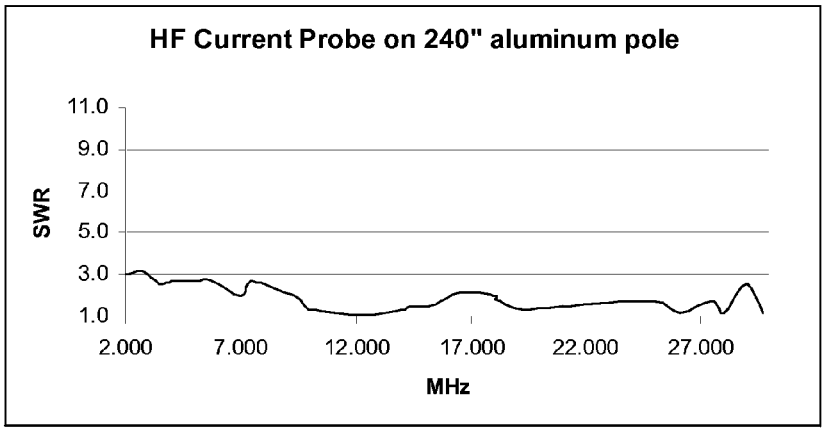
FIG. 8A shows a plot of the VSWR for a HF current probe at the base of a 609.6 cm (240 in) tall aluminum pole.
Figure 8B:
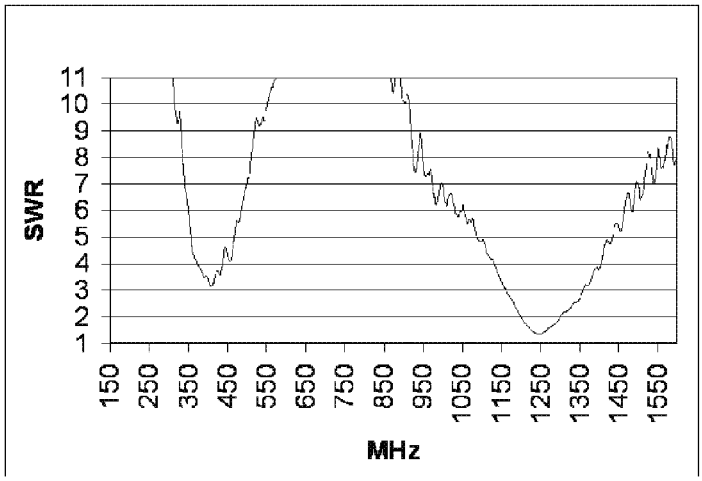
FIG. 8B shows a plot of the VSWR for a UHF current probe positioned 12.7 cm (5 in) from the base of a 50.8 cm (20 in) tall brass pole.

FIGS. 6A, 6B, 7A, 7B, 8A, and 8B show plots of the measured VSWR for various current probes 14 in various positions on the conductive structure 12. FIG. 6 shows a plot of the VSWR for a UHF current probe positioned 17.145 cm (6.75 in) from the base of a 50.8 cm (20 in) tall brass pole with a diameter of 2.54 cm (1 in). FIG. 6B shows a plot of the VSWR for a UHF current probe positioned 5.08 cm (2 in) from the base of a 50.8 cm (20 in) tall brass pole with a diameter of 2.54 cm (1 in). FIG. 7A shows a plot of the VSWR for a VHF current probe positioned 1.27 cm (0.5 in) from the base of a 50.8 cm (20 in) tall brass pole with a diameter of 2.54 cm (1 in). FIG. 7B shows a plot of the VSWR for a UHF current probe positioned 36.83 cm (14.5 in) from the base of a 50.8 cm (20 in) tall brass pole with a diameter of 2.54 cm (1 in). FIG. 8A shows a plot of the VSWR for a HF current probe at the base of a 609.6 cm (240 in) tall aluminum pole with a diameter of 10.16 cm (4 in). FIG. 8B shows a plot of the VSWR for a UHF current probe positioned 12.7 cm (5 in) from the base of a 50.8 cm (20 in) tall brass pole with a diameter of 2.54 cm (1 in). Table 1, below, provides additional frequency ranges where the VSWR is less than 3:1 for various current probes 14 in various positions on conductive structures 12 of varying sizes and material. Example materials of the conductive structure 12 include, but are not limited to: Al, Cu, brass, and Fe.

TABLE 1

| Current Probe Operating Range | Current Probe Position from base of pole | Length/Diameter/Material of Conductive Structure | Frequency Range where VSWR is less than 3:1 |
|---|---|---|---|
| UHF | 12.7 cm (5 in) | Length: 50.8 cm (20 in)<br>Diameter: 2.54 cm (1 in)<br>Material: Brass | 1063.0-1347.0 MHz |
| UHF | 20.32 cm (8 in) | Length: 50.8 cm (20 in)<br>Diameter: 2.54 cm (1 in)<br>Material: Brass | 1161.0-1358.0 MHz |
| UHF | 25.4 cm (10 in) | Length: 50.8 cm (20 in)<br>Diameter: 2.54 cm (1 in)<br>Material: Brass | 380.43-481.59 MHz<br>990.21-1327.42 MHz |
| VHF | 1.27 cm (0.5 in) | Length: 50.8 cm (20 in)<br>Diameter: 2.54 cm (1 in)<br>Material: Brass | 150.0-276.45 MHz<br>669.86-1102.62 MHz |
| L | 36.83 cm (14.5 in) | Length: 50.8 cm (20 in)<br>Diameter: 2.54 cm (1 in)<br>Material: Brass | 793.1-1021.12 MHz |
| HF | 3.81 cm (1.5 in) | Length: 609.6 cm (240 in)<br>Diameter: 10.16 cm (4 in)<br>Material: Aluminum | 2-30 MHz |

Figure 9:
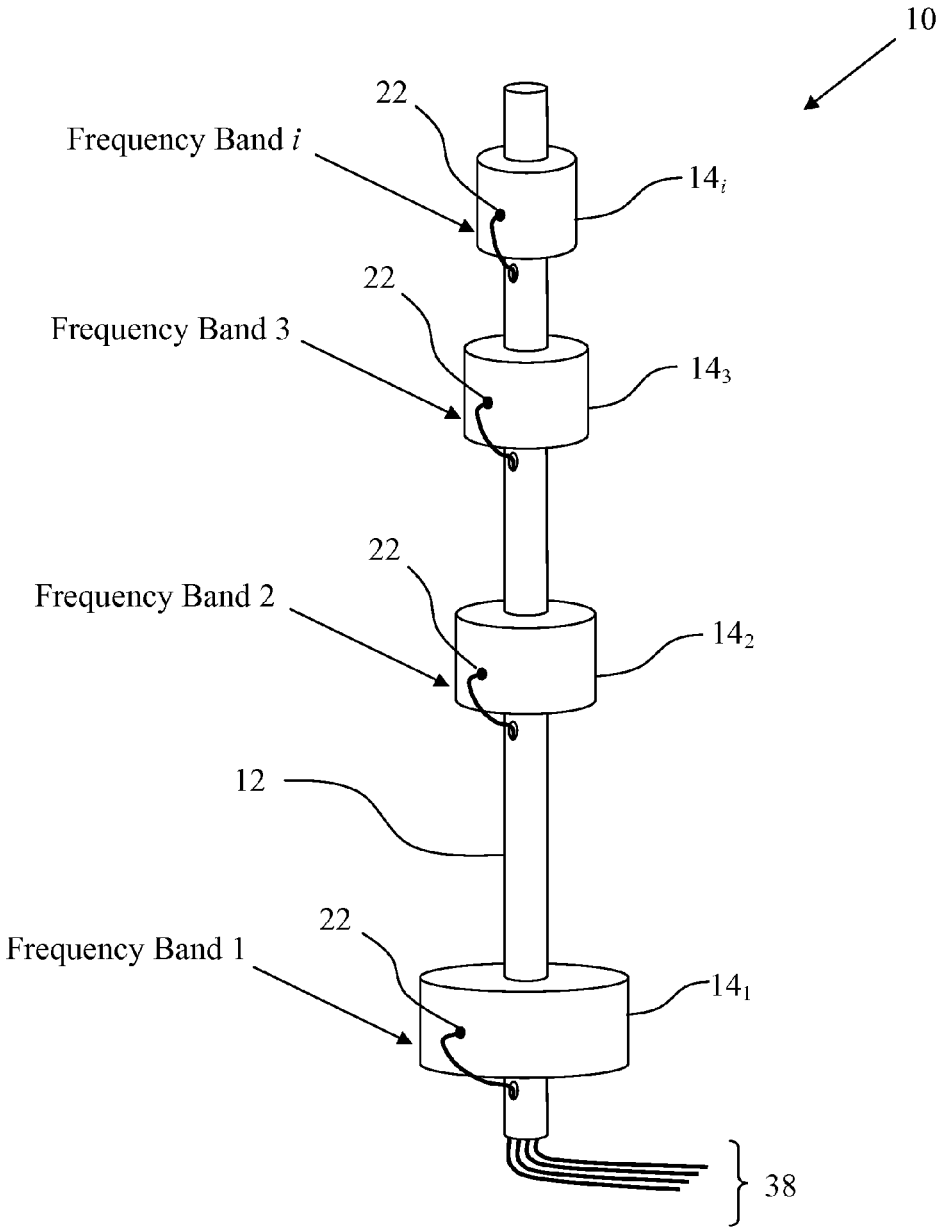
FIG. 9 is a perspective view of another embodiment of the multi-band current probe antenna with probe feeds routed through a conductive structure.

FIG. 9 is a perspective view of another embodiment of the MBCP antenna 10 with probe feeds 38 routed through a hollow conductive structure 12. As shown in FIG. 9, a probe feed 38 may be connected to each current probe 14's feed connector 22, and thereby electrically coupled to the corresponding current probe 14. Each probe feed 38 may then be routed into the hollow interior of the conductive structure 12. The probe feeds 38 may then exit the hollow interior near the base, or out the bottom, of the conductive structure 12. Each probe feed 38 may be a coaxial cable or other functionally-comparable cable or structure.

Figure 10:
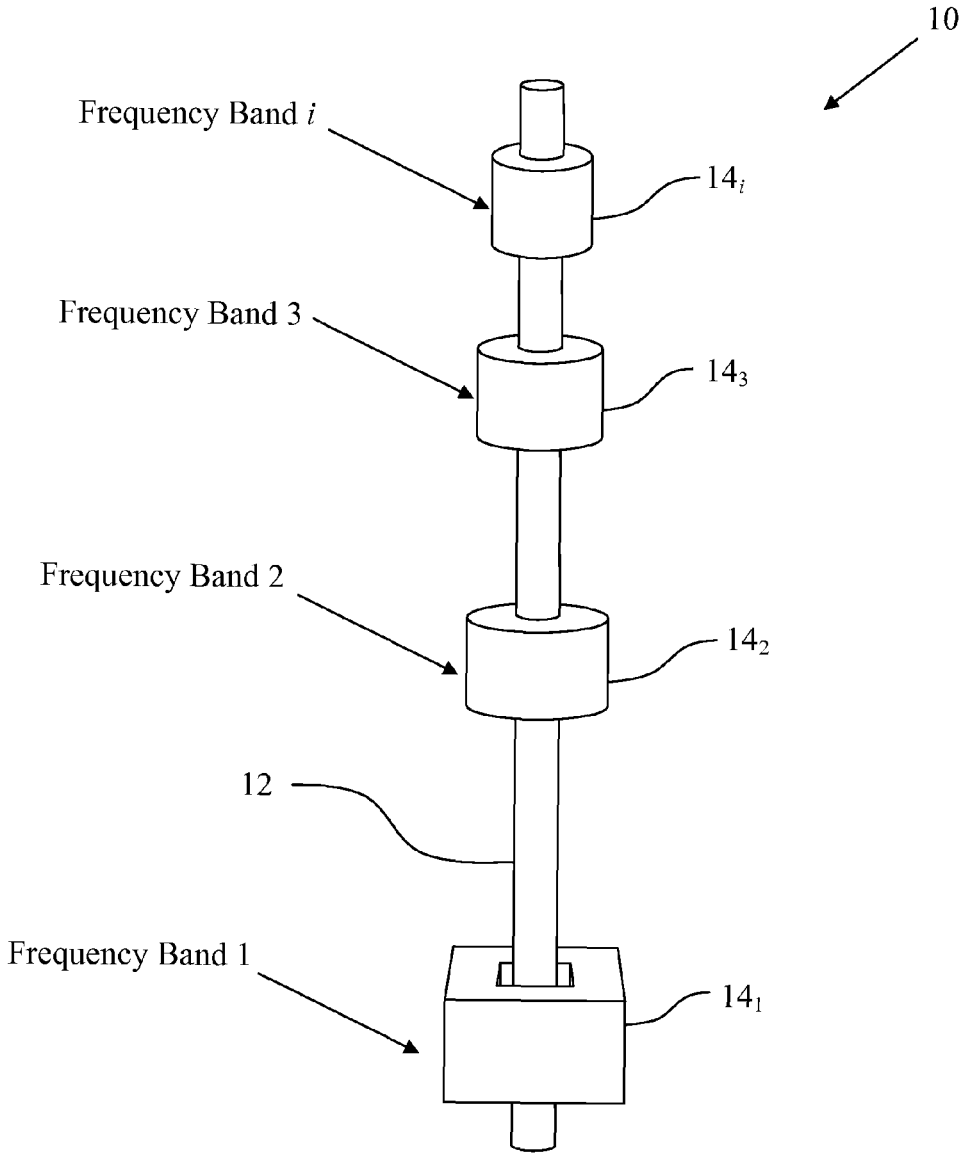
FIG. 10 is a perspective view of another embodiment of the multi-band current probe antenna showing current probes of different shapes.

FIG. 10 is a perspective view of another embodiment of the MBCP antenna showing current probes of different shapes. As mentioned above, the current probes may be any size or shape. In the embodiment shown in FIG. 10 one of the current probes is approximately a rectangular prism.

Figure 11:
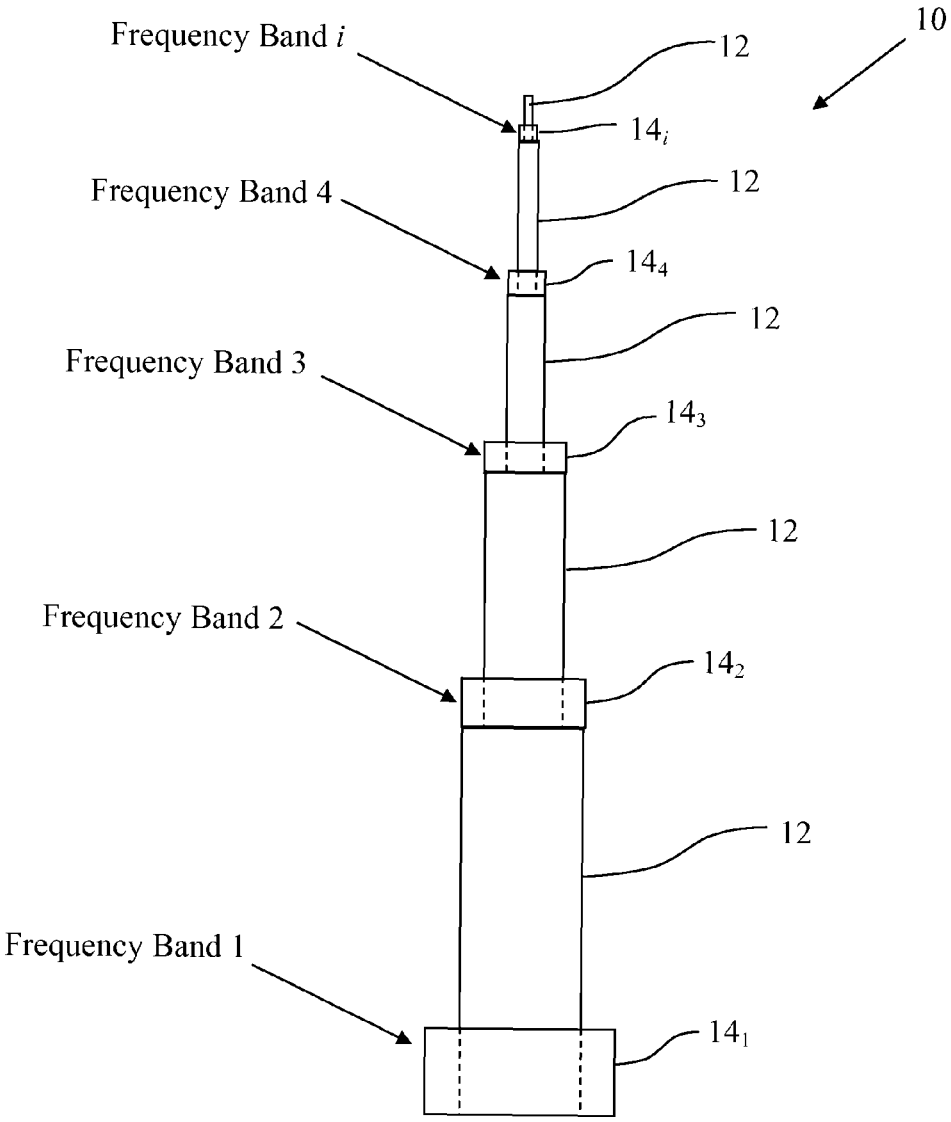
FIG. 11 is a front view of another embodiment of the multi-band current probe antenna showing a conductive structure of varying diameters.

FIG. 11 is a front view of another embodiment of the MBCP antenna 10 showing a conductive structure 12 of varying diameters. As shown in FIG. 11, each necked-down section of the conductive structure 12 is capable of supporting one of the current probes 14. Although the conductive structure 12 is shown as having a circular cross-section, it is to be understood that the conductive structure 12 may have any shape cross section around which one may couple a current probe 14.

From the above description of the MBCP antenna 10, it is manifest that various techniques may be used for implementing the concepts of the MBCP antenna 10 without departing from its scope. The described embodiments are to be considered in all respects as illustrative and not restrictive. It should also be understood that the MBCP antenna 10 is not limited to the particular embodiments described herein, but is capable of many embodiments without departing from the scope of the claims.

We claim:

1. A multi-feed, single-element, multi-band antenna comprising:

a conductive structure;

a plurality of current probes, each current probe comprising a magnetic core, wherein each core has an aperture, wherein the current probes are mounted to the conductive structure without insulating chokes or traps such that a corresponding portion of the same conductive structure is positioned within each aperture such that RF energy is transferred between the current probes and the conductive structure by way of magnetic induction;

wherein each current probe has a separate feed and is designed to receive and transmit in a substantially different frequency band than the other current probes; and wherein the current probes are positioned on the conductive structure such that the combination of the conductive structure and the current probes effectively creates a plurality of magnetic-field-coupled transmit/receive antennas such that each respective antenna has a voltage standing wave ratio (VSWR) of less than or equal to approximately 3:1 for a given range within each respective frequency band.

2. The multi-band antenna of claim 1, wherein each current probe comprises a toroidal, ferrite core.

3. The multi-band antenna of claim 2, wherein each current probe further comprises an outer conducting non magnetic housing that is insulated from the core such that the core and the conductive structure are electrically isolated from each other.

4. The multi-band antenna of claim 3, wherein each current probe further comprises a single-loop primary winding wound through the aperture and around the core.

5. The multi-band antenna of claim 4, wherein each of the plurality of transmit/receive antennas is effectively a ¼-wavelength monopole.

6. The multi-band antenna of claim 1, wherein each of the plurality of transmit/receive antennas is in effect a ¼-wavelength monopole.

7. The multi-band antenna of claim 6, wherein the plurality of current probes comprises at least four current probes, wherein at least one of the current probes is designed to transmit and receive in one of the following frequency bands:

1000 MHz-2 GHz (L-band);

400-1000 MHz (UHF);

100-400 MHz (VHF); and 2-100 MHz (HF).

8. The multi-band antenna of claim 6, wherein the conductive structure is hollow.

9. The multi-band antenna of claim 6, wherein the conductive structure is a pole having a base, wherein the ¼-wavelength monopole antennas are stacked one on top of another in order of frequency, starting with the current probe designed for the lowest frequency positioned near the base of the conductive structure, and wherein each current probe is mounted to the conductive structure at a respective distance from the base that is approximately equal to the speed of light divided by four times the frequency at which the corresponding current probe is designed to transmit and receive.

10. The multi-band antenna of claim 6, wherein the conductive structure is a building frame, such that the building frame itself functions as a radiating/receiving antenna element.

11. The multi-band antenna of claim 6, wherein the conductive structure is a metallic bridge, such that the bridge itself functions as a radiating/receiving antenna element.

12. The multi-band antenna of claim 6, wherein the conductive structure is a metallic tower, such that the tower itself functions as a radiating/receiving antenna element.

13. The multi-band antenna of claim 6, wherein the conductive structure is a flag pole, such that the flag pole as a radiating/receiving antenna element.

14. The multi-band antenna of claim 6, wherein the conductive structure is a ship, such that the ship itself functions as a radiating/receiving antenna element.

15. The multi-band antenna of claim 8, wherein the feeds are routed through the hollow space of the conductive structure.

16. The multi-band antenna of claim 4, wherein the primary winding comprises two ends, wherein one end is connected to a center conductor of a coaxial connector, and the other end is connected to the housing.

17. A multi-band antenna comprising:

a conductive structure;

four current probes, each current probe comprising a separate feed, a magnetic core, and a primary winding wound around the core, wherein each core has an aperture, wherein the current probes are mounted to the conductive structure such that a corresponding portion of the conductive structure is positioned within each aperture such that RF energy is transferred between the current probes and the conductive structure by way of magnetic induction;

wherein the four current probes are designed to receive and transmit in the HF, VHF, UHF, and L frequency bands respectively, and wherein the current probes are positioned on the conductive structure without the use of either insulating chokes or traps so as to effectively create a plurality of transmit/receive antennas such that each respective antenna has a voltage standing wave ratio (VSWR) of less than or equal to approximately 3:1 within each respective frequency band.

18. The multi-band antenna of claim 17, wherein the conductive structure is an aluminum tube.

19. The multi-band antenna of claim 18, wherein the four current probes comprise first, second, third, and forth current probes, each one designed to respectively transmit and receive in the frequency band of 1-100 MHz, 100-400 MHz, 400-1000 MHz and 1000-2000 MHz.

20. The multi-band antenna of claim 19, wherein each of the transmit/receive antennas is effectively a ¼ wavelength monopole.

21. A multi-feed, single-element, magnetic-field-coupled multi-band antenna comprising:

an antenna element configured to receive and radiate RF energy, wherein the antenna element comprises four sections, electrically-connected to each other in series;

four current injection devices, wherein each current injection device comprises a magnetic core, each core having an aperture, wherein each current injection device is mounted to a corresponding section of the antenna element without insulating chokes or traps such that a portion of the corresponding section of the antenna element passes through the aperture of the corresponding current injection device, wherein each current injection device is configured to transfer RF energy to and from the corresponding section of the antenna element by way of magnetic induction; and wherein each current injection device has a separate feed and is designed to receive and transmit in a substantially different frequency band than the other current injection devices.

* * * * *